United States Patent [19]

Fair et al.

[11] Patent Number: 4,618,403

[45] **Date of Patent: * Oct. 21, 1986**

[54] METHOD OF STABILIZING METAL-SILICA COMPLEXES IN ALKALI METAL HALIDE BRINES

[75] Inventors: David L. Fair, Chattanooga; David D. Justice, Cleveland, both of Tenn.; Pilar P. Kelly, Spartanburg, S.C.

[73] Assignee: Olin Corporation, Cheshire, Conn.

[ * ] Notice: The portion of the term of this patent subsequent to May 7, 2002 has been disclaimed.

[21] Appl. No.: 729,787

[22] Filed: May 2, 1985

Related U.S. Application Data

[63] Continuation-in-part of Ser. No. 544,677, Oct. 24, 1983, Pat. No. 4,515,665.

[51] Int. Cl.[4] ..... C25B 1/46

[52] U.S. Cl. ..... 204/98; 204/128

[58] Field of Search ..... 204/98, 128

[56] References Cited

U.S. PATENT DOCUMENTS

| | | | |
|---|---|---|---|
| 3,793,163 | 2/1974 | Dotson | 204/128 |
| 3,948,737 | 4/1976 | Cook, Jr. et al. | 204/128 |
| 4,038,365 | 7/1977 | Patil et al. | 204/128 |
| 4,055,475 | 10/1977 | Dotson et al. | 204/98 |
| 4,115,218 | 9/1978 | Krumpelt | 204/128 |
| 4,118,308 | 10/1978 | Specht | 204/98 |
| 4,155,820 | 5/1979 | Ogawa et al. | 204/98 |
| 4,176,022 | 11/1979 | Darlington | 204/128 |
| 4,202,743 | 5/1980 | Oda et al. | 204/98 |
| 4,217,187 | 8/1980 | Tufts et al. | 204/128 |
| 4,230,544 | 10/1980 | McRae | 204/98 |
| 4,236,980 | 12/1980 | Medic et al. | 204/128 |
| 4,242,185 | 12/1980 | McRae | 204/98 |
| 4,274,929 | 6/1981 | Novak | 204/98 |

*Primary Examiner*—Terryence Chapman

*Attorney, Agent, or Firm*—James B. Haglind; Thomas P. O'Day

[57] ABSTRACT

A process for electrolysis in a membrane electrolytic cell comprises feeding a concentrated alkali metal halide brine containing complex-forming elements and silica at a pH of from about 4 to about 12 to the cell. The alkali metal halide brine is electrolyzed under conditions which maintain the pH of the alkali metal halide brine at a value above about 3.5.

15 Claims, No Drawings

METHOD OF STABILIZING METAL-SILICA COMPLEXES IN ALKALI METAL HALIDE BRINES

Continuation-in-Part of U.S. Application Ser. No. 544,677, Filed Oct. 24, 1983, now U.S. Pat. No. 4,515,665.

BACKGROUND OF THE INVENTION

This invention relates to a method for treating alkali metal halide brines to stabilize silica containing colloidal complexes therein, when the treated brines are used in membrane electrolytic cells.

Alkali metal halide brines for use in membrane electrolytic cells are concentrated solutions which are prepared by dissolving the alkali metal halide in water or a less concentrated aqueous brine solution. The impurities in the brine produced vary in both types and concentration with the source of salt. Typically, the brine which is a neutral solution, contains as impurities significant concentrations of calcium, magnesium, iron, and silica as well as lower concentrations of complex-forming elements such as aluminum, zinc, tin, and lead.

To remove impurities such as calcium, magnesium and iron the brines have traditionally been treated with basic salts such as alkali metal carbonates and alkai metal hydroxides to produce as insoluble precipitates the carbonates and hydroxides of these elements. These precipitates are removed by well known settling or filtering methods. During these treatment and separation steps the concentration of silica is also reduced along with that of other elements in ionic form which react with the brine treatment agents to produce insoluble compounds.

As the ion exchange membranes employed in membrane cells are easily damaged by even moderate concentrations of elements such as calcium and magnesium, the alkaline brine is further purified by methods such as ion exchange processes.

Such brines typically have not only a pH of between about 4 and about 12, a calcium content of between about 20 and about 60 ppb, and correspondingly low contents of iron, magnesium, sulfate, chlorate and carbonate ions, but also an aluminum content of between about 0.1 and about 2.5 ppm and a silica content of between about 0.1 and about 20 ppm.

Prior to feeding the highly purified concentrated brine to the electrolytic membrane cells, the brine is acidified by the addition of an acid such as hydrochloric acid to reduce the pH to less than 4, for example, about 2–3.

During electrolysis of these brines in electrolytic membrane cells, a certain amount of hydrochloric acid and hypochlorous acid form in the brine. Even though these acids may be partially neutralized by backmigrating hydroxyl ions coming from the catholyte compartment, their concentration increases, so the anolyte pH remains highly acidic.

Maintaining the pH of the brine at highly acidic levels during electrolysis produces a chlorine gas of high purity as well as maximizing the operating efficiency of the membrane by neutralizing hydroxyl ions which backmigrate through the membrane.

The production of alkali metal halide brines as neutral solutions and the subsequent treatment under alkaline conditions stabilizes any complex containing complex-forming elements such as aluminum and silica where present in the salt or brine source. In addition, the use of mineral products such as perlite or diatomaceous earths as filter aids in the filtering or ettling methods results in increasing concentrations of these elements as well as silica in the brine.

While not wishing to be bound by theory, it is believed that in alkali metal chloride brines, the silica forms a hydrophobic colloidal sol which is readily peptized by the negative chloride ions in the brine so as to be quite stable and difficult to coagulate. Where positive ions are also present, they are strongly attracted by the negatively charged colloid to form colloidal particles of a metal silica complex which are small in size, non-aggregatable and non-ionic. Thus, they are not readily removable by precipitation, filtration or ion exchange treatments, such as those described above used to produce "conventional" membrane cell quality brines.

Where the brine is acidified before being fed to the electrolytic cell or in many cell systems using high performance membranes of a type which effectively suppress such backmigration, such as the carboxylate/-sulfonate composite described in U.S. Pat. No. 4,202,743, issued May 13, 1980 to Oda et al., during cell operation the pH of the anolyte solution is maintained within a range of about 2 to about 3. However, at such a pH, it is found that many of these complexes dissociate with any complex-forming elements present being converted to the positive ionic form. In a membrane cell, these positive ions are transported, during electrolysis, into the membrane wherein on contact with the strongly basic catholyte solution, they tend to precipitate therein, and this results in a permanent loss of membrane efficiency.

OBJECTS

It is an object of the present invention to provide a process for stabilizing complexes of silica and complex-forming elements in purified concentrated alkali metal halide brines.

It is a further object of the present invention to provide a process for stabilizing aluminum-silica complexes in purified concentrated sodium chloride brines.

It is still another object of the present invention to provide a process for electrolyzing the stabilized brine in a membrane cell so that the complexes do not dissociate therein and membrane performance is not degraded.

It is still another object of the present invention to provide a process for electrolyzing the stabilized brine in a membrane electrolytic cell so as to prevent decomposition of the complexes therein.

These and other objects of the invention will become apparent from the following description and the appended claims.

BRIEF SUMMARY OF THE INVENTION

These and other objects of the invention are accomplished in a process for electrolysis in a membrane electrolytic cell which comprises feeding a concentrated alkali metal halide brine containing complex-forming elements and silica at a pH of from about 4 to about 12 to the membrane electrolytic cell, and electrolyzing the alkali metal halide brine under conditions which maintain the pH of the alkali metal halide brine at a value above about 3.5.

DETAILED DESCRIPTION OF THE INVENTION

In the process of the present invention, stabilization of complexes of silica and complex-forming elements, particularly aluminum-silica colloidal complexes in alkali metal halide brines used in a membrane-type electrolytic cell, is accomplished by treating the brine to provide a pH of from about 4 to about 12 and preferably from about 8 to about 10, during its production or reconcentration, purification, and introduction into the cell. The cell is then operated to keep the pH of the anolyte brine above the dissociation value for the complex. The decomposition value depends both upon the nature of the constituent complex-forming element in the complex and the chemical composition of the brine in which it occurs.

By complex-forming elements is meant those chemical elements which in the presence of silica form complexes including colloidal complexes in concentrated alkali metal halide brines. Exemplary complex-forming elements include aluminum, tin, chromium, zinc, lead, arsenic, gold, platinum, antimony, and zirconium. Of these examples, aluminum, tin and arsenic are frequently found in alkali metal halide brines in concentrations high enough to effect the performance of an electrolytic membrane cell. Particularly troublesome is aluminum which can deposit in the membrane and seriously affect the operation of the cell and the life span of the membrane. Aluminum and silica, for example, form complexes in alkali metal halide brines such as sodium chloride brines having dissociation values occurring at a pH in the range from about 2.5 to about 3.5. Therefore, if the pH of the anolyte brine is kept above about 3.5 and preferably above about 4.0, no dissociation will occur during electrolysis and the aforesaid deposition of aluminum and loss of membrane efficiency is prevented.

Such an operating pH can be achieved in several ways. In a first of these, additional caustic may be added to the brine to bring it to an alkaline pH so that the any HCl and HOCl formed in the anolyte compartment during electrolysis will be sufficiently neutralized to keep the pH above the desired value.

However, aluminum-silica complexes tend to decompose in strongly alkaline media, i.e. a pH in excess of about 12, with both the silica and aluminum being dissolved. Since the normal pH of the brine, after ion exchange is between about 8 and about 10, and since the ion exchange resins used for final calcium and magnesium removal are usually not adapted to work well at high pH levels, the additional caustic must be added to the brine after such ion exchange, usually at the head tank manifold for the cell. In so doing, care must be used to prevent the anolyte brine during operation of the cell from reaching a pH much in excess of 6. At this level, at least some of the hydroxyl ions will be discharged at the anode, causing unwanted oxygen to appear in the chlorine product stream recovered from the cell.

A second and preferred embodiment of the present invention is to operate the cell in a manner which acts to increase the backmigration of hydroxyl ions through the membrane to a degree sufficient to keep the pH at the desired level.

It has been found that this can be done, even with the aforesaid high performance membranes, if a slight modification is made in the way cell startup is performed. In many membrane cells, startup is normally performed with a caustic solution having between about a 32% to about a 35% concentration in the catholyte compartment. Under such conditions, the membrane is conditioned to allow relatively few hydroxyl ions to backmigrate into the anolyte compartment and current efficiency is maximized. As noted hereinabove, with relatively few hydroxyl ions appearing in the anolyte compartment, the aforesaid HCl and HOCl remain largely unneutralized with the anolyte brine reaching pH values in the range of about 2–3.

In the process of the present invention, such a situation is avoided by modifying the cell startup procedure to promote a sufficiently high level of hydroxyl ion backmigration to prevent the pH of the anolyte brine from attaining the normal 2–3 level but rather maintaining the pH of the anolyte at above about 3.5 and most preferably at about 4. Control of the anolyte pH during cell operation is accomplished by operating the cell at reduced current efficiencies, for example at efficiencies below about 95%. At these lower current efficiencies sufficient concentrations of hydroxyl ions are present in the anolyte to maintain the anolyte pH at above about 3.5 or above the decomposition value of the complex. One way in which the lower current efficiencies are achieved is accomplished by producing lower concentrations of alkali metal hydroxide in the catholyte solution at startup and adjusting the catholyte flow conditions to allow it to slowly build up to the "normal" 32–40% caustic product concentration. In the process of the present invention, the startup caustic concentration is from about 26% to about 30% NaOH and preferably between about 27% to about 29% and the build up time is between about 15 to about 35 days and preferably from about 23 to about 30 days, all other cell operating parameters remaining the same.

When this is done, a complex containing silica and a complex-forming element such as aluminum remains stable in the anolyte and very low levels of aluminum are precipitated within the membrane. This permits substantially longer membrane life to be achieved when compared to normal startup procedures at high current efficiencies.

Further, although the overall current efficiency at startup is maintained at a lower level than that attained with the normal startup procedure, as the caustic concentration is built up in the catholyte compartment the current efficiencies are increased. Once the caustic concentration is maximized, the cell operating parameters including the current efficiency tend to remain fairly constant during a prolonged period of cell operation. Contrarily, it is observed that where a high concentration of caustic is used at cell startup, current efficiencies, while higher at the start, decline and, further, that the cell operating parameters vary erratically during prolonged operation.

Although the above-described cell operating procedure stabilizes any aluminum-silica colloidal particles present in the brine, the continuous addition of silica and aluminum to the brine by the aforementioned resaturation and brine treatment steps may necessitate that an amount of aluminum and silica, more or less equal to the amounts added, be removed to prevent an unacceptable build up of these components within the circulating brine stream. Currently used brine reconditioning practices present several opportunities to do so. For example, to alleviate similar build up problems with sulfate and chlorate ions in the brine, a portion of the brine is routinely removed after dechlorination and discarded from the system. Such routine "purging" will significantly lower the complex level in the brine.

Another treatment frequently applied is the acidification of at least a portion of the depleted dechlorinated brine to below the decomposition value, for example, a pH of less than about 2 as a means of decomposing the hypochlorite ion concentration therein. At this level, the complex dissociates to form ionic aluminum which may then be removed by conventional processes such as precipitation or ion exchange. Further, hypochlorite decomposition may be abetted by the addition of an oxidizable material to the brine. In one such process, as defined in U.S. Pat. No. 404,465, issued to Moore and Dotson on Sept. 20, 1983, oxalic acid is added to the acidified brine. Where the removal of aluminum from the brine is desired as well, such a process could be adjusted to provide a controlled excess of oxalate ions to foster the formation and precipitation of aluminum oxalate therefrom prior to reconstituting the brine for reuse in the cell.

EXAMPLE 1

A prototype membrane electrolytic cell having about a 3.5 $m^2$ sulfonate/carbonate membrane therein was operated with a circulating sodium chloride brine as the anolyte feedstock. During operation, the depleted brine produced during electrolysis was recovered, dechlorinated and resaturated using standard procedures. It was then successively treated with excess concentrations of 1.0 gpl $Na_2CO_3$ and 0.5 gpl of NaOH to precipitate calcium, magnesium, and heavy metals such as iron. After settling for about 9 hours, the resaturated brine was finally conditioned for cell use by filtering it to a 1–3 micron nominal retention and passing it through a cation exchange bed of CR-10 resin at a pH of 8–10, a temperature of 60°–70° C. at a 40 bed volume/hour flow rate. This produced a brine having a calcium content of about 40 ppb, an aluminum content averaging about 1.5 ppm and a silica content averaging about 6 ppm. No other treatments were applied to remove aluminum or silica.

The cell was charged with a 28% NaOH catholyte solution which, after electrolysis was started, was slowly raised, over a period of 25 days to a concentration of 32%. By so doing, it was found that the pH of the discharged, depleted brine always remained above 4.0 at an operating temperature of 90° C.

Operating at a steady cell voltage of about 3.4, the current efficiency rose with increasing catholyte concentration from 90% to 95% after 30 days of operation while power consumption declined from 2500 to about 2400 KWH/ton of caustic at which levels they stayed for essentially the entire length of the run. The salt content in the depleted brine was constant at about 200 gpl.

After 101 days, cell operation was discontinued and the membrane removed. Visual inspection of the membrane after shut down showed no evidence of damage on the cathode side of the membrane. Acid extraction analysis showed the membrane had an aluminum content of 1.6 mg/$dm^2$. X-ray fluoroescence (XRF) results showed a major Si peak and minor peaks of Al, Si, Cl and Ca on the cathode side. Scanning Electron Micrographs (SEM) of the cathode surface of the membrane showed it to be relatively smooth.

COMPARATIVE EXAMPLE A

The run of Example 1 was repeated with the exceptions that the pH of the feedstock was lowered to a range of 2 to 3 by the addition of hydrochloric acid thereto after the final ion exchange treatment and a 32% NaOH catholyte solution was used from the start of electrolysis.

The cell was operated under these conditions for 64 days during which time the current efficiency declined from about 97% to about 92%, while the power consumption increased from 2500 to 2700 KWH/ton. During the run, the cell voltages varied irregularly between about 3.6 and 3.75.

At the conclusion of the run, the membrane was removed. Visual examination showed it to be distinctly "whiter" than was observed with the membrane of Example 1. Acid extraction analysis showed an aluminum content of 12 mg/$dm^2$ while XRF analysis showed major peaks for Al, Si and S and a minor Ca peak on the cathode side. An SEM inspection of the cathode surface showed it to be considerably rougher than the membrane in Example 1.

This invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A process for electrolysis in a membrane electrolytic cell for producing an alkali metal hydroxide which comprises feeding a concentrated alkali metal halide brine containing complex-forming elements and silica at a pH of from about 4 to about 12 to said membrane electrolytic cell, and electrolyzing said alkali metal halide brine under conditions which maintain said pH of said alkali metal halide brine at a value above about 3.5.

2. The process of claim 1 in which said complex-forming elements are selected from the group consisting of aluminum, tin, chromium, zinc, lead, arsenic, gold, platinum, antimony, and zirconium.

3. The process of claim 2 in which the concentration of said silica in said alkali metal halide brine is from about 0.1 to about 20 parts per million.

4. The process of claim 3 in which the current efficiency of said membrane electrolytic cell during the start up period is maintained below about 95%.

5. The process of claim 4 in which the pH of said alkali metal halide brine fed to said membrane electrolytic cell is from about 8 to about 10.

6. The process of claim 4 in which said complex-forming element is selected from the group consisting of aluminum, tin and arsenic.

7. The process of claim 6 in which said alkali metal halide brine during electrolysis is maintained at a pH of above about 4.

8. The process of claim 7 in which said alkali metal halide is an alkali metal chloride or an alkali metal bromide.

9. The process of claim 8 in which said alkali metal chloride is sodium chloride.

10. The process of claim 9 in which said complex-forming element is aluminum.

11. The process of claim 10 in which during cell startup the concentration of sodium hydroxide in said cathode compartment is between about 26% and about 30%.

12. A process for electrolysis in a membrane electrolytic cell for producing an alkali metal hydroxide which comprises feeding a concentrated alkali metal halide brine containing a complex of at least one complex-forming element and silica at a pH of from about 4 to about 12 to said membrane electrolytic cell, and electrolyzing said alkali metal halide brine under conditions which maintain the pH of said alkali metal halide brine above the decomposition value of said complex.

13. The process of claim 12 in which said alkali metal halide brine is sodium chloride.

14. The process of claim 13 in which said complex-forming element is aluminum.

15. A process for electrolysis in a membrane electrolytic cell for producing an alkali metal hydroxide which comprises feeding a concentrated alkali metal halide brine containing aluminum and silica at a pH of from about 4 to about 12 to the membrane electrolytic cell, and electrolyzing said alkali metal halide brine under conditions which maintain said pH of said alkali metal halide brine at a value above about 3.5.

* * * * *